United States Patent [19]

Wessel

[11] 4,064,851

[45] Dec. 27, 1977

[54] SERVO CONTROLLED EXHAUST GAS RECYCLE SYSTEM

[75] Inventor: Wolf Wessel, Oberriexingen, Germany

[73] Assignee: Robert Bosch GmbH, Stuttgart, Germany

[21] Appl. No.: 713,855

[22] Filed: Aug. 12, 1976

[30] Foreign Application Priority Data

Sept. 5, 1975 Germany ..... 2539484

[51] Int. Cl.[2] ..... F02M 25/06

[52] U.S. Cl. ..... 123/119 B; 137/637.1

[58] Field of Search ..... 123/119 B

[56] References Cited

U.S. PATENT DOCUMENTS

| | | | |
|---|---|---|---|
| 2,516,547 | 7/1950 | Carlson et al. | 123/119 B |
| 3,570,461 | 3/1971 | Guarnaschelli | 123/119 B |
| 3,673,994 | 7/1972 | Aono | 123/119 B |
| 3,678,909 | 7/1972 | Barker et al. | 123/119 B |

FOREIGN PATENT DOCUMENTS

| | | | |
|---|---|---|---|
| 1,476,162 | 3/1964 | Germany | 123/119 B |
| 2,229,185 | 6/1972 | Germany | 123/119 B |

*Primary Examiner*—Wendell E. Burns
*Attorney, Agent, or Firm*—Edwin E. Greigg

[57] ABSTRACT

An exhaust gas recycle valve adjusts the amount of exhaust gas returned to the induction manifold and the degree of opening of the recycle valve is controlled by the main throttle valve. In one embodiment of the invention, an extended throttle shaft carries a set of contact strips and a complementary shaft, coupled to the exhaust gas valve, carries contact pins which cooperate with the contact strips to open or close an electrical connection between a power source and an electric motor. When the strips and the pins are rotated relative to one another, as when the throttle is moved, the motor is energized and adjusts the position of the exhaust gas valve until the relative position of the strips and the pins is again such as to interrupt conduction.

11 Claims, 2 Drawing Figures

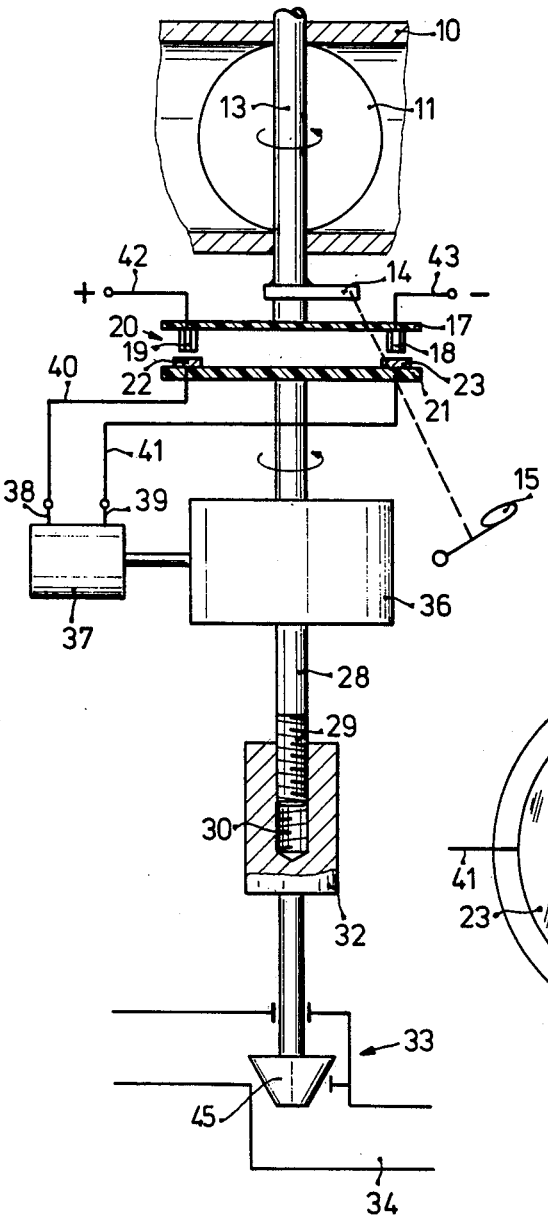
Fig.1
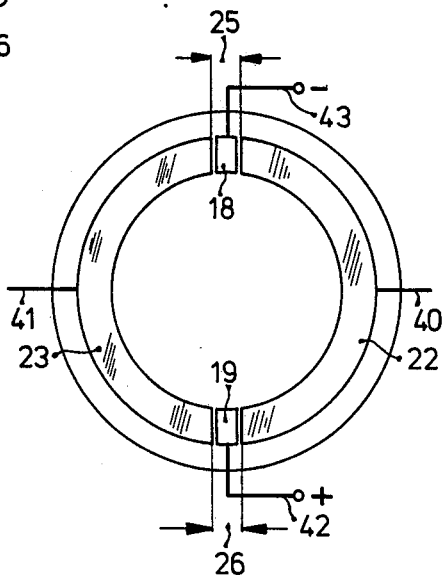

SERVO CONTROLLED EXHAUST GAS RECYCLE SYSTEM

BACKGROUND OF THE INVENTION

The invention relates to an exhaust gas recycle system for an internal combustion engine with an auxiliary power source for changing the position of a bypass closure valve.

A bypass control system has been made known by U.S. Pat. No. 3,842,814 in which the auxiliary valve-setting force is the vacuum in the induction tube of an internal combustion engine. The vacuum is used for varying the opening of the bypass valve by controlling the inlet opening for atmospheric air pressure in accordance with the position of the throttle valve. This system has the disadvantage that the position of the exhaust gas recycle valve cannot be made to exactly correspond to the position of the throttle valve. Furthermore, this system is very expensive and has the further disadvantage that, except when the control opening is entirely closed, the engine constantly receives bypass air in varying quantities.

Another known system proposes a cam for changing the closing member of an exhaust gas recycle valve which is coupled directly to the throttle valve shaft. While, in this system, the actuating cam can be embodied so as to move the exhaust gas recycle valve at the same time as the throttle valve, there is the distinct disadvantage that, if the exhaust gas recycle valve were to jam or if substantial friction were to develop in the linkage to the throttle valve, the latter would fail to close completely since, in general, its closure is assured only by the force of a return spring. Under such circumstances, the engine would be supplied with an excessive amount of mixture and if the engine were relieved of its load, for example by actuation of the clutch, the engine could experience an excessive speed causing destruction or damage.

OBJECT AND SUMMARY OF THE INVENTION

It is a principal object of the invention to provide an apparatus for controlling the amount of exhaust gas recycled to the engine by adjustment of an exhaust gas recycle valve corresponding to the opening of the throttle. It is a further object of the invention to provide a system of this type in which the malfunction of the recycle valve will not adversely affect the operation of the throttle valve, in particular its complete closure.

These and other objects are attained by providing the exhaust gas recycle valve with a position transducer which cooperates with a mating position indicating element on the throttle valve shaft. The invention further provides a switching system which actuates a servo power drive that causes the closure member to return to a position of relative zero displacement if it is displaced therefrom. In this manner, the closing element of the exhaust gas recycle valve imitates the rotational motion of the throttle valve shaft. The torque which the throttle valve shaft must exert to produce the concurrent motion of the bypass valve member is very small, being only large enough to provide the very small frictional forces generated when the position transducers slide against one another.

In an advantageous embodiment of the invention, the switching system includes two separate contact strips forming part of the transducer and the mating portion of the transducer being formed by two contact pins which, in the stationary state, mate with the separation between the two contact strips. If the two cooperating parts of the transducer are relatively rotated, the contact pins make contact with one or the other of the two contact rails and are thereby able to provide a potential of alternating polarity to a suitable servo motor drive.

In another exemplary embodiment, the switching apparatus uses a fluid medium and provides a cylindrical bushing with two axially sequential, partial annular slits separated by a bridge and cooperating with a rotating piston which has two axially sequential bores that cooperate with the partial annular slits. If one bore of the piston receives vacuum while the other receives atmospheric pressure and if the piston is rotated relatively to the cylinder so that the bores and the annular slits overlap, a hydraulic or air pressure servo motor will be supplied with pressure of alternating direction so as to actuate the closure member of the exhaust gas recycle valve. In both of the exemplary embodiments described, the power required to operate the recycle valve is provided by a servo motor whose operability does not depend on the position or condition of the throttle valve. Any frictional forces added by the system to be overcome by the throttle valve are only those very small sliding forces which the moving transducer portions exert on one another.

The invention will be better understood as well as further objects and advantages thereof become more apparent from the ensuing detailed specification of two exemplary embodiments taken in conjunction with the drawing.

BRIEF DESCRIPTION OF THE DRAWING

FIG. 1 is a partially schematic side view of a first exemplary embodiment of the system according to the invention and inclues a top view of the cooperating portions of the position transducer.

DESCRIPTION OF THE PREFERRED EMBODIMENTS

Figure 2:
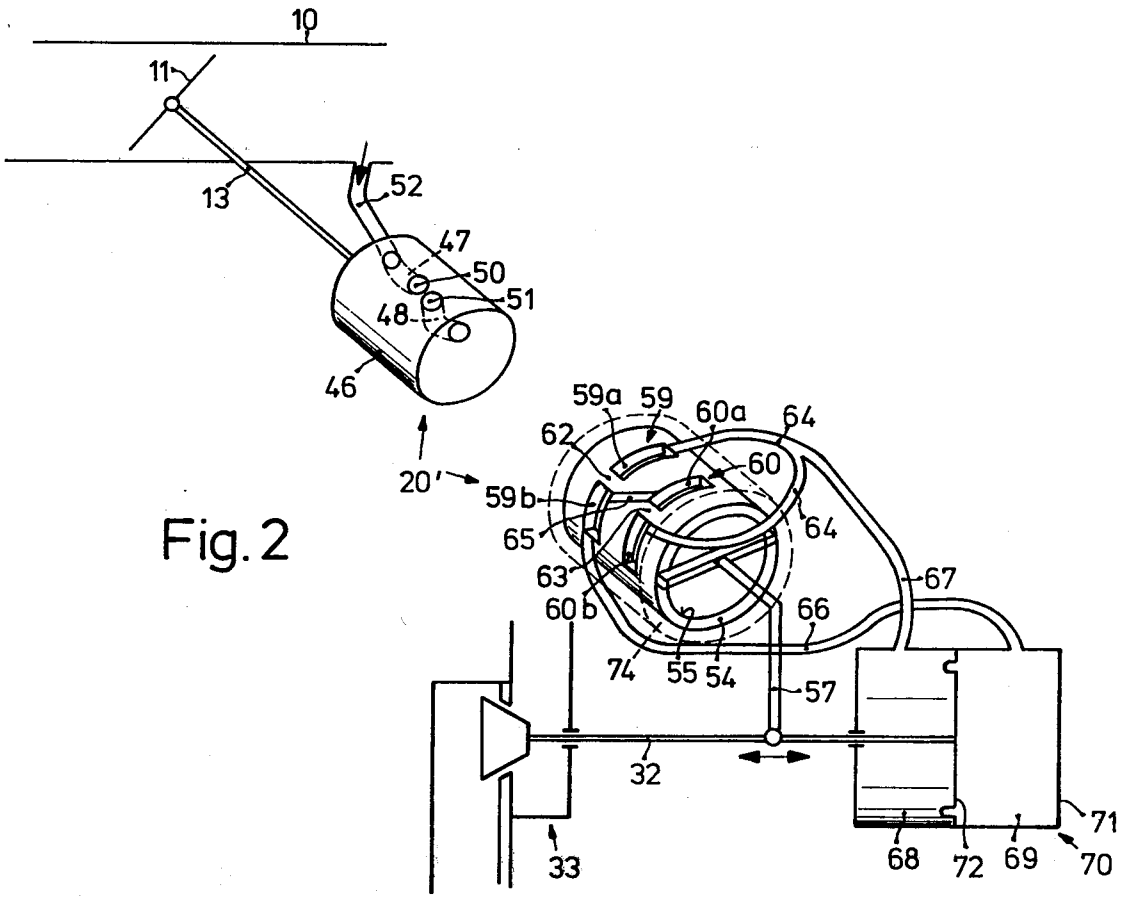
FIG. 2 is an exploded view of the second embodiment of the invention in which the cooperating transducer is hydraulic or air-operated.

Turning now to FIG. 1, there is shown a portion of the induction tube 10 of an internal combustion engine, not further illustrated, including a throttle valve 11 which pivots about a throttle valve shaft 13. The rotation of the throttle valve shaft 13 is caused via a linkage 14 and other linkage, not shown, by actuation of a gas pedal 15.

The end of the throttle shaft 13 carries an insulated disc 17 with affixed electric contact pins 18 and 19 which form part of a switching system 20. Adjacent to and coaxial with the carrier 17 there is disposed rotatably an insulated carrier disc 21 with two contact strips 22, 23 which forms the second portion of the position transducer in the switching system 20. The electrical continuity of the two contact strips is interrupted by rest positions 25, 26 which are slightly larger than the diameters of the contact pins 18 and 19 which glide over the contact strips 22, 23.

The carrier disc 21 is affixed to a rotating shaft 28 whose other end is provided with threads 29 which mate with internal threads 30 in a block 32 belonging to the closure element of an exhaust gas recycle valve. 33. The exhaust gas recycle valve 33 may be of known construction and is located in an exhaust gas recycle line 34 connected between the exhaust system and the induction system of the engine which is not further shown. The valve may be of any suitable construction and is shown only schematically.

The shaft 28 is driven by a transmission 36 which, in turn, is powered by an electric motor 37. The electric motor may be of any suitable construction which permits operation in opposing directions of motion by changing the polarity of contacts 38, 39. The contacts 38 and 39 are connected by conductors 40, 41, respectively, with contact strips 22, 23, respectively. The contact pins 18 and 19 are connected via movable conductors 42 and 43, respectively, with positive or negative voltage for supplying energy to the electric motor.

The apparatus described above operates as follows:

When the throttle valve shaft 13 is rotated by actuation of the gas pedal 15, the disc 17 rotates. Since, in the initial position, the contact pins 18 and 19 normally would have been opposite the zero positions, i.e., the interruptions in the contact strips 22 and 23, a rotation will cause the pins to make contact with the strip 22 or the strip 23, depending on the direction of rotation. In this manner, there is created an electrical connection, for example between the positive voltage source through the line 42 to contact 19 and strip 22 to the pin 38 of the electric motor and a return path from the electric motor pin 39, the strip 23, the contact pin 18 and the conductor 43, to the negative voltage source. When this electrical path is established, the electric motor turns so that the shaft 28 is rotated by the transmission 36. The direction of rotation of the shaft 28 is such that the carrier disc 21, to which the strips are attached, follows any rotation of the carrier disc 17 until such time as the pins 18 and 19 are again positioned in the intermediate positions 25 and 26 between the contact strips, thereby interrupting the supply of current to the motor.

During the rotation of the shaft 28, the threaded end 29 cooperates with the internal threads 30 of the valve-closing member 32 to move the latter. The directions of the threads are so chosen that, when the throttle valve closes, the bypass closure valve 33 also closes.

If the throttle shaft 28 rotates in the opposite direction, the entire process described above occurs in reverse. By appropriate choice of the threads 30 and 29 and of the form of the valve closure member 35, the stroke and opening cross section can be adapted to any position of the throttle valve shaft as required.

In the embodiment described above, the recognition of the intermediate zero positions is obtained by purely mechanical means. It will be understood by a person skilled in the art that the recognition of the zero positions can also be performed by any suitable electronic means and in contact-free manner, for example by static field transducers, by inductive transducers, etc., operating, if necessary, with a subsequent amplification stage. If contact-free sensors are used, no frictional forces occur and no wear and tear takes place.

In a second exemplary embodiment of the invention illustrated in FIG. 2, similar parts are provided with similar reference numerals. A throttle valve 11 with a throttle valve shaft 13 is located rotatably in an induction tube 10 and carries a position transducer embodied as a rotating piston 46. The rotating piston is provided with two substantially axial bores 47 and 48, the bore 47 terminating in an aperture 50 on the surface of the piston and the bore 48 terminating on the surface of the piston in another aperture 51. The opposite side of the bore 47 is connected to the induction tube 10 downstream of the throttle valve 11 by a flexible hose 52. The end of the bore 48 remote from the piston terminates in the atmosphere. The cooperating portion of the transducer in the switching mechanism 20 for this second embodiment is a cylindrical bushing 54 which surrounds the rotating piston 46 tightly in operation. To clarify the arrangements of cooperating elements in the second embodiment, these have been represented in an exploded view.

The cylindrical bushing 54 is connected to the valve closing member 32 of the exhaust gas recycle valve 33 via linkage 57. This is indicated schematically by a lever connected to the stub of a drive shaft attached to the bushing 54. The cylindrical bushing 54 has two axially sequential, partial annular slits 59 and 60 which are separated by bridges 62 and 63 into partial slits **59*a* and 59*b* and 60*a* and 60*b*. The separation of the partial annular slits 59 and 60 in the axial direction is the same as that of the termini 50 and 51 in the piston. When the piston 46 is rotated with respect to the cylindrical bushing 54, the terminus 50 may cooperate with the partial annular slit 59 and the terminus 51 cooperates with the partial annular slit 60, for example. The width of the bridges 62 and 63 is such that they are able to obturate the terminal apertures 50 and 51** when properly positioned.

Diagonally opposing slit portions **59*a* and 60*b* (as well as 59*b* and 60*a*) are in communication through lines 64 and 65, respectively. Furthermore, each of the slit groups so joined is connected by a line 66 and 67, respectively, with a work chamber 69 and 68, respectively, belonging to a servo motor 70. The servo motor has a closed actuating cylinder 71 in which the two work chambers 68 and 69 are created by a movable diaphragm 72. Connected to the movable diaphragm is the shaft of the valve-closing member 32 which is passed through the cylinder to the outside in air-sealing manner. The connecting lines 64 through 67 are indicated only schematically. In an actual embodiment, these connecting lines would normally be channels machined within the casing of the cylindrical bushing. A supplementary sleeve 74, which would seal the partial annular slits and the connecting lines 65, 64** with respect to the outside, is indicated only schematically by dashed lines. The packing required to seal the sliding portions of the actuator can be of any suitable type and is not shown.

The apparatus of the second embodiment of the invention operates in the following manner:

As long as the outlet apertures 50 and 51 lie in the vicinity of the bridges 62 and 63, the work chambers 68 and 69 receive neither vacuum from bore 47 nor atmospheric pressure from bore 48. When the throttle valve shaft is rotated, the relative position of the piston and the rotating bushing may be such that, for example, the outlet openings come to lie in the region of the partial annular slits **59*a* and 60*a*, respectively. In that case, the first work chamber 68 receives vacuum through the slit 59*a* and the line 67, while the second work chamber 69 is connected with the atmosphere through the line 66, the slit 59*b*, the line 65, the slit 60*a* and the line 48. Thus, the net force acting on the diaphragm 72 acts to open the exhaust gas recycle valve 33 by sliding the valve member 32 and, at the same time, rotating the cylindrical bushing 54 via the linkage 57 until such time as the bridges 62 and 63 are again in superposition with the outlets 50 and 51. At this instant, the motion of the valve member 32 is interrupted because no further pressure change takes place in the work chambers. If the throttle valve is rotated further, the work chambers continue to receive pressure in such a manner that, when the throttle valve opens, the work chamber 68 is evacuated increasingly until the throttle valve and the exhaust gas recycle valve 33 are completely opened. By contrast, if the throttle valve shaft rotates in the closing direction, the work chamber 69 is evacuated and the pressure in the work chamber 68 is elevated until it reaches atmospheric pressure. Since the rotation of the piston is immediately followed by a complementary rotation of the cylindrical bushing 54, the work chambers 68 and 69 are connected with their respective pressure souces only for a very short time so that the pressures in the work chambers rise continually up to their maximum value. For this reason, the elastic diaphragm 72 and the valve member 32** connected thereto continuously change position.

The pressure sources used in the preceding exemplary embodiment have been indicated to be the atmospheric air and the induction tube vacuum. However, any other source of vacuum would be suitable for connection to the hose 52 or the bore 47. In similar manner, the entire process may be carried out with hydraulic fluid as control medium. Yet again, the piston and cylindrical bushing may be replaced in analogous fashion by a transducer formed from a disc and slits therein.

The two preferred examples described have the common feature that, as soon as the outlet apertures 50 and 51 overlap the bridges 62 and 63 (second embodiment) or the contact pins 18 and 19 lie in the vicinity of the separations 25 and 26 (first embodiment), the system requires no further input energy. A suitable dimensioning of the valve member 45 within the exhaust gas recycle valve 33 can be used to achieve any desired adaptation of the flow cross section, i.e., the amount of exhaust gas recycled at any particular throttle valve position. The common feature of both exemplary embodiments of the system of the invention is that the torque required to actuate the exhaust gas recycle valve is reduced to a minimum so that any malfunction or jamming of the exhaust gas recycle valve 33 will have no effect on the functioning of the throttle valve itself, particularly its closing.

The foregoing represents preferred exemplary embodiments of the invention, it being understood that variants thereof are possible within the spirit and scope of the invention, the latter being defined by the appended claims.

What is claimed is:

1. In an exhaust recycle system for an internal combustion engine, said system including adjustable valve means adapted to be opened and closed in accordance with the position of the throttle of the engine, the improvement comprising switch means, composed of two complementary switch parts, the first of said switch parts being attached to and moving with said valve means and the second of said complementary switch parts being attached to and moving with said throttle; whereby the cooperation of said first and second switch parts provides a switching action for opening and closing said adjustable valve means.

2. A system as defined in claim 1, wherein said first switch part includes a carrier provided with at least two electrically conductive strips which are separated by non-conductive gaps and said second switch part includes a carrier provided with at least two conductor elements for providing selective alternative electrical contact with respective ones of said conductive strips and with respective ones of said non-conductive gaps.

3. A system as defined by claim 2, further including an electric motor connected to be actuated by said switch means.

4. A system as defined by claim 3, including sources of opposite electrical potential connected to two of said electrically conductive strips and said conductor elements, the other two of said conductive strips and said conductor elements being connected to said electric motor.

5. A system as defined by claim 4, wherein said conductive strips are in the shape of circular arcs.

6. A system as defined by claim 4, further providing transmission means for transmitting rotary motion from said electric motor to movable portions of said valve means.

7. A system as defined by claim 1, wherein said first switch part includes a cylindrical bushing with two axially sequential partial annular slits each divided by unperforated bridges and wherein said second switch part is a piston moving within said first switch part and is provided with two internal bores having axially sequential termini for providing selective alternative communication with respective ones of said partial annular slits, one of said bores being provided with atmospheric pressure and the other of said bores being provided with pressure different from atmospheric pressure, wherein each of said annular slits is divided into a first and second half and including conduit means for providing communication from the first half of one of said annular slits to the second half of the other of said annular slits and conduit means for providing communication from the second half of one of said annular slits to the first half of the other of said annular slits.

8. A system as defined by claim 7, further including hydraulic servo motor means with two work chambers, one of said work chambers being connected to the first of said conduit means and the second of said work chambers being connected to the second of said conduit means and wherein said pressure different from atmospheric pressure is engine vacuum.

9. A system as defined by claim 1, wherein said first and second switch parts are static electric field plates and wherein said system further includes an electronic switching system controlled by said static field plates and servo motor means actuated thereby to open and close said adjustable valve means.

10. A system as defined by claim 1, wherein said first and second switch parts are complementary parts of an inductive transducer and wherein said system further includes an electronically controlled servo motor, actuated by said inductive transducer to open and close said adjustable valve means.

11. A system as defined by claim 1, wherein said first and second switch parts are complementary portions of an optical transducer and wherein said system further includes an electronically controlled servo motor drive actuated by said optical transducer for opening and closing said adjustable valve means.

* * * * *